US009663128B2

(12) United States Patent
Johnson et al.

(10) Patent No.: US 9,663,128 B2
(45) Date of Patent: May 30, 2017

(54) LOCATION AND/OR DIRECTION OF TRAVEL DETECTION SYSTEM AND METHOD

(71) Applicant: ALSTOM TRANSPORT TECHNOLOGIES, Saint-Ouen (FR)

(72) Inventors: John Johnson, Melbourne, FL (US); Michael Scott Mitchell, Grain Valley, MO (US); Aadeesh Shivkant Bhagwatkar, Bangalore (IN); Bruce Ruthenberg, Melbourne, FL (US); Sunetha Ghanta, Bangalore (IN)

(73) Assignee: ALSTOM TRANSPORT TECHNOLOGIES, Saint-Ouen (FR)

( * ) Notice: Subject to any disclaimer, the term of this patent is extended or adjusted under 35 U.S.C. 154(b) by 43 days.

(21) Appl. No.: 14/698,130

(22) Filed: Apr. 28, 2015

(65) Prior Publication Data

US 2016/0318531 A1 Nov. 3, 2016

(51) Int. Cl.
*B61L 25/02* (2006.01)
*B61L 27/00* (2006.01)

(52) U.S. Cl.
CPC ..... *B61L 25/02* (2013.01); *B61L 25/023* (2013.01); *B61L 25/025* (2013.01); *B61L 25/026* (2013.01); *B61L 27/0088* (2013.01)

(58) Field of Classification Search
CPC ... B61L 25/0231; B61L 25/025; B61L 25/026
See application file for complete search history.

(56) References Cited

U.S. PATENT DOCUMENTS

| | | | | |
|---|---|---|---|---|
| 4,174,674 | A * | 11/1979 | Reid | G06G 1/0005 116/307 |
| 7,826,938 | B2 | 11/2010 | Kato et al. | |
| 8,400,270 | B2 | 3/2013 | Brand | |
| 2003/0183697 | A1 | 10/2003 | Porter | |
| 2005/0010338 | A1 | 1/2005 | Kraeling et al. | |
| 2005/0205719 | A1 | 9/2005 | Hendrickson et al. | |
| 2005/0240322 | A1 | 10/2005 | Peltz et al. | |
| 2008/0055043 | A1 | 3/2008 | Webb et al. | |

(Continued)

OTHER PUBLICATIONS http://www.getransportation.com/its/train-optimization/onboard-train-control-solutions/ultra-cab-ii-signaling; Ultra Cab II Signalling; Bring Safety on Board; Dated Apr. 23, 2015; 3 pgs.

*Primary Examiner* — Fadey Jabr
*Assistant Examiner* — Thomas Ingram
(74) *Attorney, Agent, or Firm* — Christopher R. Carroll; The Small Patent Law Group LLC

(57) ABSTRACT

A system and method for determining a direction of travel of a vehicle and/or identifying a misplaced wayside device obtain location data from wayside devices. The location data are representative of locations of the wayside devices along a route being traveled by a vehicle. The system and method also determine whether the location data in a series of the wayside devices exhibit an increase or a decrease in the location data across the wayside devices in the series and, responsive to determining whether the location data in the series of the wayside devices does exhibit the increase or the decrease in the location data, the system and method determine a direction of travel of the vehicle along the route, determine a location of the vehicle along the route, and/or identify a misplaced wayside device.

21 Claims, 3 Drawing Sheets

(56) References Cited

U.S. PATENT DOCUMENTS

| | | | | |
|---|---|---|---|---|
| 2008/0068164 | A1 | 3/2008 | Campbell | |
| 2014/0263862 | A1 | 9/2014 | Morris | |
| 2016/0001803 | A1* | 1/2016 | Kim | G01S 13/06 246/124 |

* cited by examiner

LOCATION AND/OR DIRECTION OF TRAVEL DETECTION SYSTEM AND METHOD

FIELD

Embodiments of the subject matter described herein relate to determining a location and/or direction of a powered system, such as a vehicle.

BACKGROUND

Vehicle systems may use a variety of methods to determine locations of the vehicles as the vehicles move along routes. For example, rail vehicles may use global positioning system receivers and/or radio frequency identification (RFID) tags installed along a railway track to determine the locations of the vehicles. The vehicles may interrogate the RFID tags with an RFID reader to determine the location of the vehicle along the route. For example, the tags may be programmed with a location value. The location value may represent a distance or location of the tag along the route. For example, a location value of 500 that is programmed into a tag may indicate that tag is 500 meters from a designated location along the route.

Some tags may be installed in incorrect locations or become misplaced during maintenance of the route. Some tags may be programmed with the correct location information, but due to error in replacing the tags when the tags are moved to perform maintenance on the route, the tags may be inadvertently placed in incorrect locations along the route. For example, the locations of two tags may be inadvertently switched. These tags may be referred to as misplaced tags.

Some vehicles rely in the reading of these tags to ensure safe operation of the vehicles. For example, rail vehicles may read the tags to determine where the vehicles are located and/or what direction the vehicles are traveling along the route. The vehicle location and/or direction of travel that is determined from the tags may then be used to determine how fast the vehicles are allowed to travel, whether the vehicles are allowed or prohibited from entering into certain locations, whether brakes of the vehicles should be automatically engaged in that location, or the like. Misplaced tags can provide incorrect location information to the vehicles and, as a result, pose a significant safety risk.

BRIEF DESCRIPTION

In one embodiment, a method (e.g., for determining a direction of travel of a vehicle) includes obtaining location data from wayside devices. The location data are representative of locations of the wayside devices along a route being traveled by a vehicle. The method also can include determining whether the location data in a series of the wayside devices exhibit an increase or a decrease in the location data across the wayside devices in the series and, responsive to determining whether the location data in the series of the wayside devices does exhibit the increase or the decrease in the location data, determining one or more of a direction of travel of the vehicle along the route and/or a location of the vehicle along the route.

In another embodiment, a system (e.g., a direction of travel determining system) includes a tag reader device and a controller. The tag reader device is configured to obtain location data from wayside devices. The location data is representative of locations of the wayside devices along a route being traveled by a vehicle. The controller is configured to determine whether the location data in a series of the wayside devices exhibit an increase or a decrease in the location data across the wayside devices in the series and, responsive to determining whether the location data in the series of the wayside devices does exhibit the increase or the decrease in the location data, to determine a direction of travel of the vehicle along the route.

In another embodiment, a method (e.g., for identifying a misplaced tag along a route) includes obtaining location data from radio frequency identification tags disposed at different locations along a route. The location data is representative of the locations of the tags along the route from a designated location. The method also includes determining whether the location data in a series of at least three neighboring tags includes a sequential increase or a sequential decrease in the location data across the at least three neighboring tags and, responsive to determining that the location data across the at least three neighboring tags does not include the sequential increase or the sequential decrease in the location data, identifying one or more of the at least three neighboring tags as a misplaced tag.

DETAILED DESCRIPTION

Figure 1:
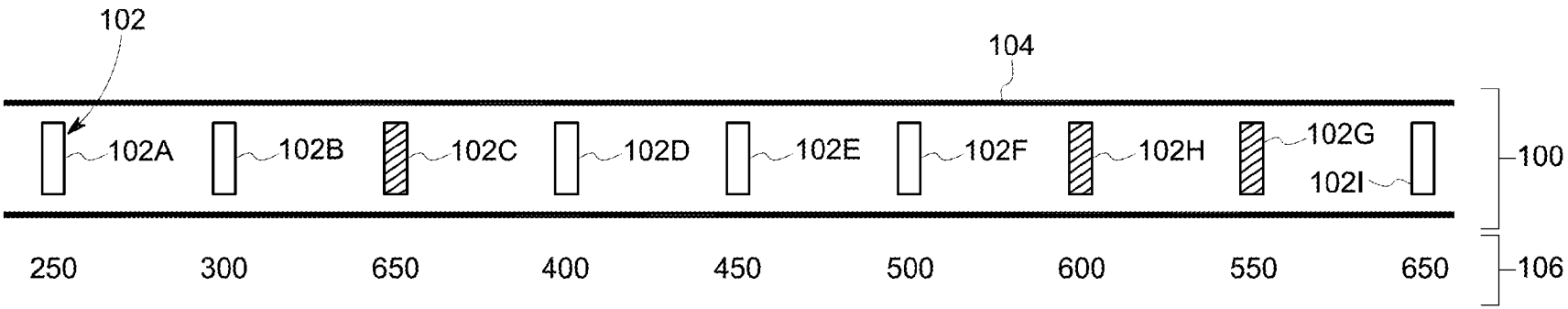
FIG. 1 is a schematic illustration of a route having several wayside devices disposed along the route according to one embodiment.

One or more embodiments of the inventive subject matter described herein provide systems and methods that examine wayside devices disposed alongside a route being traveled on by one or more vehicles in order to determine locations and/or directions of travel of the vehicles. While the description herein focuses on rail vehicles and RFID tags disposed on or alongside railways traveled by the rail vehicles, not all embodiments are limited to RFID tags or rail vehicles. For example, one or more embodiments described herein may relate to other types of vehicles such as automobiles, marine vessels, mining vehicles, or other off-highway vehicles (for example, vehicles that are not designed or legally permitted for travel on public roadways). Optionally, the locations and/or directions of travel of the vehicles may be determined by examining wayside devices other than RFID tags. For example, the systems and methods described herein may visually examine one or more signs disposed along a route, magnetically read one or more tags disposed along a route, or the like.

One or more embodiments described herein relate to the reading of wayside devices to determine locations and/or directions of travel of vehicles to ensure safe operation of the vehicles. Additionally or alternatively, the locations and or directions of travel may be determined for other types of vehicle control. For example, determining the locations and/or directions of travel as described herein may be used to verify the vehicle is traveling at the correct location and/or direction of travel (for example, as dictated by a trip plan that designates operational settings of the vehicle as a function of time and/or distance along a route, such as speeds, locations, throttle settings, brake settings, or the like), to allow for autonomous, driverless operation of the vehicle, or for other uses.

At least one technical effect of the subject matter described herein provides for increased accuracy and verification of locations and/or directions of travel of vehicles as determined by reading wayside devices. This increased accuracy and verification of locations and/or directions of travel can improve the safe operation of the vehicles and may avoid or eliminate accidents caused by the incorrect location and/or direction of travel of the vehicle.

In one embodiment, the systems and methods described herein examine a series of tags disposed alongside a route to detect a misplaced tag in contrast to examining only a single tag at a time. The tags may be installed along the route and separated by one or more designated or known distances. For example, the tags may be installed along a route in locations that are fifty meters apart from each other. The tags can be programmed with location data representative of where the tags are located. As described below, the vehicles may determine distances traveled by the vehicles (e.g., "determined vehicle locations") in order to determine or identify misplaced tags. The determined vehicle locations may be determined by the vehicles from a location determining device (such as a global positioning system receiver, wireless triangulation, a speed sensor where the speed of rotation of one or more wheels is compared is used with sizes of the wheels to determine how far the vehicles traveled, or the like).

In operation, a vehicle travels along a route having the tags installed on or near the route. As a vehicle travels along the route, a tag reader device disposed onboard the vehicle reads location data from the tags. The location data can represent locations of the tags. For example, the tag reader device may generate electromagnetic waves the wirelessly interrogate the tags. Responsive to receiving the waves, the tags may wirelessly communicate data representative of a location of the tag to the tag reader device onboard the vehicle. During travel of the vehicle, a location and/or direction of travel determining system of the vehicle can validate a tag location against the tag location of a previous tag. For example, the system may calculate a tag location difference (TLD) as an absolute value of the difference between a current or most recent tag location (as determined from the currently interrogated tag or the most recently interrogated tag) and a previous tag location (from the tag prior to the current tag, or another tag those interrogated prior to the current or most recent tag).

The system also can calculate an expected location difference (ELD) as an absolute value of a difference between the determined vehicle location and the previous tag location. A tag location error (TLE) can be calculated as the absolute value of a difference between expected location difference and the tag location difference. If the tag location error is within a designated error tolerance range, then the current tag may accurately reflect the location of the vehicle. For example, the locations indicated by these tags can be determined to be accurate and/or correct. The error tolerance range can be the larger of a designated error amount and a percentage of a distance traveled between the tags in the series. As one example, the designated error tolerance range can be the larger of twenty meters (or another distance) or a designated percentage (e.g., 5% or another percentage) of the tag location difference. Alternatively, the error tolerance range can have another value.

The sequence of location data obtained from the series of tags can be examined to determine a direction of travel of the vehicle and/or to determine if the tags have been misplaced. For example, the location data from a series of three or more tags (or another number of tags) can be examined. The series of tags may include neighboring or sequential tags in a direction of travel along the route. If the location data stored in the series of tags consistently increases or decreases across the tags in the series, then the location data can indicate that the tags in the series are in the correct order and have not been misplaced.

For example, if a first tag that is encountered by the vehicle has a first value for the location data (e.g., one hundred meters), a second tag that is subsequently encountered by the vehicle has a larger, second value for the location data (e.g., one hundred fifty meters), and a third tag that is subsequently encountered by the vehicle has an even larger, third value for the location data (e.g., two hundred meters), then the location data of the tags in this series indicate that the tags are in the correct order and have not been misplaced. Similarly, if a first tag in another series of tags has a fourth value for the location data (e.g., six hundred meters), a second tag that is subsequently encountered by the vehicle has a smaller, fifth value for the location data (e.g., five hundred fifty meters), and a third tag that is subsequently encountered by the vehicle has an even smaller, sixth value for the location data (e.g., five hundred meters), then the location data of the tags in this series indicate that the tags are in the correct order and have not been misplaced.

Conversely, if the location data of the series of tags is not a sequential increase or decrease in values, then one or more of the tags in the series may be misplaced. For example, if a first tag that is encountered has a first value for the location data (e.g., three hundred meters) and a second tag that is subsequently encountered has a larger, second value for the location data (e.g., three hundred fifty meters), but a third tag that is subsequently encountered has a third value (e.g., one hundred meters) that is smaller than the second value, then the values of the location data of these tags in the series are not consistent in that the values do not sequentially increase. As another example, if a first tag that is encountered in another series of tags has a fourth value for the location data (e.g., one hundred meters) and a second tag that is subsequently encountered has a smaller, fifth value for the location data (e.g., fifty meters), but a third tag that is subsequently encountered has a sixth value (e.g., one hundred fifty meters) that is larger than the fifth value of the second tag, then the values of the location data of these tags in the series are not consistent in that the values do not sequentially decrease.

Identifying a series of tags that do not have consistently increasing or consistently decreasing values for the location data can indicate that one or more of the tags has been misplaced. As a result, the location data of these tags may not be used to determine a direction of travel of the vehicle and/or to determine a location of the vehicle.

FIG. 1 is a schematic illustration of a route 100 having several wayside devices 102 (e.g., devices 102A-I) disposed along the route according to one embodiment. The wayside devices 102 optionally may be referred to as tags 102. These tags can represent RFID tags that store location data representative of a location of a tag 102 relative to a fixed or designated location. Alternatively, the tags 102 can represent signs that are optically read by a camera or other device, magnetic devices that are magnetically read, or the like. The route 100 can represent a track formed from two or more rails 104 that is traveled by rail vehicles, a road, or other surface or medium on which vehicles can travel.

Location data 106 associated with the different tags 102 are shown in FIG. 1 below the corresponding tag 102. For example, location data 106 that is associated with the tag 102A is 250, which can represent that the tag 102A is two hundred fifty meters from a known or designated location. The location data 106 may be recorded or otherwise stored in the tags 102 such that, upon reading the tag 102, the location data 106 is obtained from the tag 102.

The tags 102 may be located approximately fifty meters away from each other along the route 100. Alternatively, the tags 102 may be another distance apart from each other. In the illustrated example, three of the tags 102 have incorrect location data 106 and/or are misplaced along the route 100. For example, the tag 102C is programmed with incorrect location data 106. The tags 102G and 102H are misplaced tags in that the locations of the tags 102G, 102H have been switched. Instead of the tag 102H being between the tag 102F and the tag 102G, and the tag 102G being between the tags 102H, 102I, the tag 102G should be correctly positioned between the tags 102F, 102H and the tag 102H should be correctly positioned between the tags 102G, 102I. The positions of the tags 102G, 102H may have been switched during maintenance or repair of the route 100. For example, during the repair or maintenance of the route 100, the human operator may have removed the tags 102G, 102H. Upon completion of the maintenance or repair of the route 100, the operator may not have placed the tags 102G, 102H back in the previous positions of the tags 102G, 102H.

Figure 2:
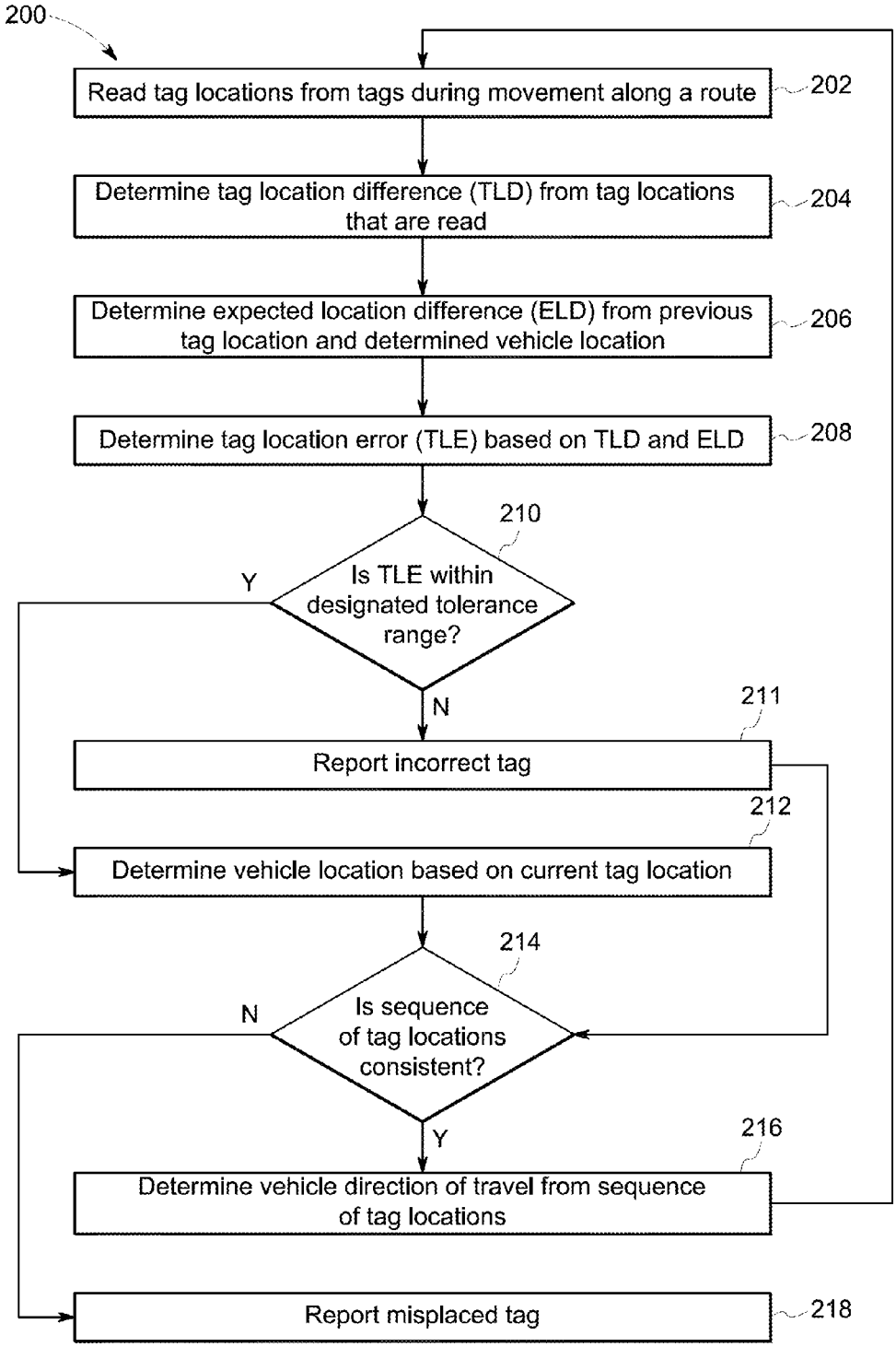
FIG. 2 illustrates a flowchart of one embodiment of a method for determining a location and/or direction of travel of a vehicle, and/or for identifying a misplaced tag.

With continued reference to the tags 102 shown in FIG. 1, FIG. 2 illustrates a flowchart of one embodiment of a method 200 for determining a location and/or direction of travel of a vehicle. The method 200 may be performed by reading the location data 106 from the tags 102 as a vehicle travels along the route 100.

At 202, tag locations are read from the tags 102 during movement of the vehicle along the route 100. The tags 102 may be read by a tag reader device disposed onboard the vehicle. The tag reader device may include an RFID reader that interrogates the tags 102 with electromagnetic waves, a camera that reads information printed on the tags 102, or other type of device that can read location data 106 from the tax 102.

At 204, a tag location difference (TLD) is determined from the location data 106 that are read from the tags 102. The tag location difference may be determined as the absolute value of the difference between the location data 106 stored in two or more neighboring tags 102. For example as a vehicle travels over the tags 102A, 102B, the vehicle may read the location data 106 from the tag 102A as two hundred fifty meters and the location data 106 of the tag 102B as three hundred meters. The tag location difference between the tags 102A, 102B may then be calculated as fifty meters.

At 206, an expected location difference (ELD) is determined from a previous tag location and a determined vehicle location. The previous tag location may be the location data 106 read from a previous tag 102 while the determined vehicle location may be the distance that the vehicle has traveled along the route 100 from a designated location. The expected location difference may represent the absolute value of the difference between the location data 106 of a previous tag 102 and a location of the vehicle as calculated by a device other than the tag reader device. For example, the determined vehicle location may be obtained from a global positioning system receiver that determines how far the vehicle has traveled along the route 100 from the previous tag 102. As another example, the determined vehicle location may be calculated by counting a number of rotations of a wheel or axle of the vehicle that have occurred since the vehicle passed the previous tag 102 and a circumference of the wheel or axle of the vehicle.

The expected location difference may be the same as or substantially similar to the tag location difference if the location data 106 of the tags 102 is accurate and the determined vehicle location is accurately measured. The determined vehicle location may be measured as the distance that the vehicle has moved from the same or substantially same location as the designated location from which the location data 106 is measured. For example, if the location data 106 of the tag 102B indicates that the tag 102B is located three hundred meters from a designated location along the route 100, then the determined vehicle location may be measured as three hundred meters from the same designated location.

With respect to the tags 102A, 102B, as the vehicle reaches or approaches the tag 102B, the previous tag location may be the location data 106 stored in the tag 102A (e.g., two hundred fifty meters). As one example, the global positioning system receiver of the vehicle may determine that the vehicle has traveled three hundred fifty-five meters from the same designated location from which the location data 106 of the tag 102A was measured. As a result, the expected location difference from the previous location of the tag 102A and the determined vehicle location may be fifty-five meters.

At 208, a tag location error (TLE) is determined based on the tag location difference and the expected location difference. The tag location error may represent an absolute value of a difference between the tag location difference and the expected location difference. With respect to the tags 102A, 102B, the tag location difference determined at 204 may be fifty meters while the expected location difference determined at 206 may be fifty-five meters. As a result, the tag location error may be calculated as five meters.

At 210, a determination is made as whether or not the tag location error is within a designated tolerance range. The designated tolerance range may be one or more distances that, if the tag location error is within the range of distances, the location data 106 of the current tag 102 (e.g., the tag 102 that is being read by the vehicle, the most recently read tag 102, or another tag 102) may accurately reflect the location of the vehicle. In one aspect, the designated tolerance range is the larger value of a designated error value and a percentage of a distance traveled between tags 102. As one example, the designated tolerance range may be the larger of twenty meters or 5% of the tag location difference, whichever is larger. Alternatively, the designated tolerance range may have another value.

If the tag location error is within the designated tolerance range, then the location data 106 read from the current tag 102 may accurately reflect the location of the vehicle. For example, with respect to the tags 102A, 102B, the tag location error of five meters (as determined at 208), may be within the designated tolerance range of the larger of twenty meters or 5% of the tag location difference (for example, 5% of fifty meters). As a result, flow of the method 200 can proceed to 212. On the other hand, if the tag location error is not within the designated tolerance range, then the location data 106 read from the tags 102 may not accurately reflect the location of the vehicle. As a result, flow of the method 200 can proceed to 211.

At 212, the location of the vehicle is determined based on the current tag location. With respect to the tags 102A, 102B, because the tag location error calculated for the tags 102A, 102B is within the designated tolerance range, the vehicle location may be determined as being the location data 106 of the current tag 102B, or three hundred meters from a designated location. A location of the vehicle that is stored (at least temporarily) onboard the vehicle may be updated using the location obtained from the current tag location. For example, a location of the vehicle that is tracked by the location determining device 308 may be updated (e.g., changed) to the current tag location. This can prevent inaccuracies of the location determining device 308 from accumulating over time (e.g., due to position uncertainty in global positioning system signals, errors in wheel diameter measurements, etc.). As another example, a location of the vehicle that is used by a controller of the vehicle, that is used by an energy management system of the vehicle (that generates trip plans dictating operational settings or speeds of the vehicle as a function of distance along the route), that is used by a safety system (e.g., a controller that applies brakes of the vehicle if the vehicle enters into a prohibited area), or the like, may be updated with the current tag location.

At 214, a determination is made as to whether or not a sequence of the location data 106 stored in a series of tags 102 is consistent. For example, subsequent to reading the location data 106 from the tags 102A, 102B, the location data 106 may be read from a third tag 102C in a series of sequential or neighboring tags 102 formed by the tags 102A, 102B, 102C. The location data 106 may be consistent across the series of tags 102 if the location data 106 increases from the tag 102A to the tag 102B and from the tag 102B to the tag 102C, or if the location data 106 decreases from the tag 102A to the tag 102B and from the tag 102B to the tag 102C.

In the illustrated embodiment, a vehicle traveling along the route 100 across the tag 102A then across the tag 102B then across the tag 102C does identify location data 106 of the tags 102A, 102B, 102C that demonstrates a consistent sequence of location data 106 across the series of tags 102A, 102B, 102C. Because the location data increases from the tag 102A to the tag 102B and from the tag 102B to the tag 102C, the sequence of tag locations among the series of tags 102A, 102B, 102C is consistent. A consistent sequence of tag locations can indicate that there is not two or more misplaced tags 102 among the series of tags 102 examined in the sequence at 214. As a result, flow of the method 200 can proceed toward 216 to determine a direction of travel of the vehicle. On the other hand, if the sequence of tag locations is not consistent across the series of tags 102, then there may be two or more misplaced tags 102 within the series of tags 102. As a result, flow of the method 200 can proceed from 214 to 218.

At 216, a direction of travel of the vehicle is determined from the sequence of tag locations examined at 214. With respect to the tags 102A, 102B, 102C, because the sequence of location data 106 of these tags 102A, 102B, 102C demonstrates a consistent increase in the location data 106 of the tags 102A, 102B, 102C, the vehicle direction of travel may be determined as proceeding from left to right in the view of FIG. 1 (for example, from tag 102A to tag 102B to tag 102C). In one aspect, flow of the method 200 may return to 202 from 216. Alternatively, operation of the method 200 may terminate subsequent to 216.

As another example of operation the method 200, during travel over the tags 102B and 102C, at 202, the location data 106 is read from the tags 102B, 102C during movement of the vehicle along the route 100. At 204, the tag location difference between the location data 106 of the tags 102B, 102C is determined. For example, the absolute difference between the tag location data 106 of six hundred fifty meters and three hundred meters is calculated as three hundred fifty meters.

At 206, the expected location difference is calculated from the previous tag location and the determined vehicle location. If the vehicle has reached the tag 102C, the determined vehicle location may be calculated as three hundred fifty meters (e.g., if the tag 102C is fifty meters away from the tag 102B). The absolute value of the difference between the location data 106 of the tag 102B (e.g., three hundred meters) and the determined vehicle location of three hundred fifty meters (or another value) may be calculated as the expected location difference (e.g., fifty meters).

At 208, the tag location error is determined based on the tag location difference and the expected location difference. With respect to the tags 102B, 102C, the tag location error can be calculated as the absolute value of the difference between three hundred fifty meters (for example, the tag location difference determined at 204) and fifty meters (for example, the expected location difference determined at 206). As a result, the tag location error may be calculated as three hundred meters.

At 210, a determination is made as to whether or not the tag location error is within a designated tolerance range. If the designated tolerance range is the larger of twenty meters or 5% of the tag location difference, a determination may be made as to whether or not the tag location error of three hundred meters is within a range of twenty meters. Because the tag location error is larger than the designated tolerance range, the location data 106 of the tag 102C may not be accurate. As a result, flow of the method 200 can proceed toward 211.

At 211, an incorrect tag is reported. For example, because the tag location data 106 of the tag 102C is incorrect, the tag 102C may be reported as an incorrect tag. An incorrect tag 102 may include a tag 102 that is in the wrong location, a tag 102 that is programmed with the wrong location data 106, and/or a tag 102 that is corrupted, or the like. The reporting of an incorrect tag 102 may be provided to an operator of the vehicle is traveling over the route 100 and/or to an off-board location, such as a repair facility, scheduling facility, vehicle dispatch facility, or the like.

Responsive to reporting the incorrect tag 102, one or more remedial actions may be implemented. For example, responsive to receiving a report of an incorrect tag 102, the repair facility may schedule repair and/or inspection of the tag 102 that is reported as being misplaced, a scheduling facility may create and/or alter one or more schedules of vehicles to prevent the vehicles from traveling over the incorrect tag 102, or the like.

In addition to or in place of reporting the incorrect tag, the location of the vehicle as determined by the location determining device 308 may not be updated (e.g., changed) to the value of the current tag location at 211. For example, in contrast to the updating of the vehicle location in the location determining device 308 as described above in connection with 212, the location determining device 308 (or other component) may not change the vehicle location to the location determined from the incorrect tag at 211.

With respect to travel over the tags 102D, 102E, 102F, the method 200 may proceed as follows. At 202, the location data 106 is read from the tags 102D and 102E. At 204, the tag location difference from the location data 106 of the tags 102D and 102E can be calculated. In the illustrated example, the tag location difference is calculated as fifty meters (for example, four hundred fifty meters read from the tag 102D and four hundred meters read from the tag 102D).

At 206, the expected location difference between the previous tag location and the determined vehicle location is determined. The previous tag location may be location data 106 read from the tag 102D. The determined vehicle location may be, for example, four hundred sixty meters from the same location that the location data 106 for the tags 102 is measured from. The expected location difference may then be calculated as sixty meters (e.g., the difference between four hundred sixty meters and four hundred meters).

At 208, the tag location error can be calculated based on the tag location difference and the expected location difference. With respect to the tags 102D, 102E, the tag location error may be calculated as an absolute value of the difference between sixty meters (e.g., the expected location difference) and fifty meters (e.g., the tag location difference). As a result, the tag location error may be calculated as ten meters.

At 210, a determination is made as to whether or not the tag location error of ten meters is within the designated tolerance range. As described above, the designated tolerance range may be the larger of twenty meters or 5% of the tag location difference (or another value). Using such a designated tolerance range, the tag location error of ten meters is smaller than (or within the range of) the designated tolerance range. As a result, flow of the method 200 can proceed to 212.

At 212, the vehicle location is determined based on the current tag location. For example, location of the vehicles determined as being the location data 106 of the tag 102E, or four hundred fifty meters from a designated location. At 214, a determination as to whether or not the sequence of tag locations is consistent. For example, the vehicle may examine the location data 106 associated with or read from the tag 102D and the location data associated with or read from the tag 102E. Upon reaching the tag 102F, the vehicle may read additional location data 106 from the tag 102F. The location data 106 of the series of tags that includes the tags 102D, 102E, 102F may be examined to determine if the location data 106 includes an increasing sequence or a decreasing sequence from the tag 102D to the tag 102E, and from the tag 102E to the tag 102F. In the illustrated example, because the location data 106 of the tag 102D is four hundred meters, the location data 106 of the tag 102E increases to four hundred fifty meters, and the location data 106 of the tag 102F increases to five hundred meters, the series of tags 102D, 102E, 102F do exhibit or include location data 106 that has a consistently increasing sequence. As a result, flow of the method 200 can proceed to 216.

At 216, the vehicle direction of travel is determined from the sequence of tag locations. For example, because the location data 106 of the tags 102D, 102E, 102F increases consistently across the series of tags 102D, 102E, 102F, then the vehicle direction of travel may be determined as being from left to right in the view of FIG. 1. The method 200 may return to 202, or alternatively may terminate following 216.

But, if the location data 106 of the tags 102 in the series of tags 102 is not a consistent sequence, then the direction of travel of the vehicle may not be determined based on the location data 106 of the tags 102. For example, in connection with travel over the series of tags 102F, 102H, 102G as shown in FIG. 1, the location data 106 of the first tag 102F that is encountered is five hundred meters, the location data 106 of the second tag 102H that is encountered is six hundred meters, and the location data 106 of the third tag 102G that is encountered is five hundred fifty meters (which may be determined at 202 and/or 214 in the method 200). Upon comparing the location data 106 in the series of the tags 102F, 102H, 102G at 214, however, the location data 106 does not increase or decrease from tag-to-tag. For example, the location data 106 indicates an increase in distances when traveling from the tag 102F to the tag 102H, but then indicates a decrease in distances when traveling from the tag 102H to the tag 102H. Because the location data 106 in tags 102 that are in the correct locations should indicate only increases or only decreases in distances when traveling in a single direction (e.g., increases when traveling left to right in the view of FIG. 1 or decreases when traveling right to left in the view of FIG. 1), the location data 106 of the tags 102F, 102H, 102G indicate that one or more of the tags 102F, 102H, 102G are located in incorrect locations.

As a result, the determination made at 214 is that the series of tags 102F, 102H, 102G does not have a consistent sequence of location data 106. As a result, flow of the method 200 can proceed from 214 toward 218. At 218, a misplaced tag is reported. For example, the tag 102H and/or the tag 102G may be reported as a misplaced tag. The misplaced tag may be reported to an operator of the vehicle and/or to an off-board location. For example, a signal may be communicated to a repair facility and, in response to receiving the signal, the repair facility may automatically schedule repair or inspection of the tags 102F, 102G, and/or 102H along the route 100. Flow of the method 200 may return to 202 from 218, or alternatively may terminate.

As one example, when the vehicle reaches a properly placed tag 102F of the route 100, the location determining device 308 can set the vehicle location to 500 meters. When misplaced tags 102H and 102G are encountered, the location determining device 308 may not set the vehicle location to the location data in those tags. Instead, the location determining device 308 can continue to update the vehicle location according to information from the distance sensor(s). But, when tag 102I is encountered, the tag 102I is found to be properly placed relative to the last properly placed tag 102F, and the vehicle location is set to the location data in the tag 102I.

The tag location distance from the tag 102F to the tag 102I is 150 meters in the illustrated example. The expected location difference will be approximately 150 meters, because the location determining device 308 may increase the location by approximately 150 meters while traveling from the tag 102F to the tag 102I. The tag location error at the tag 102I may be within the tolerance described above. As a result, the tag 102I can be considered to be properly placed, and the vehicle location can be set to the location data in the tag 102I (e.g., 650 meters).

Figure 3:
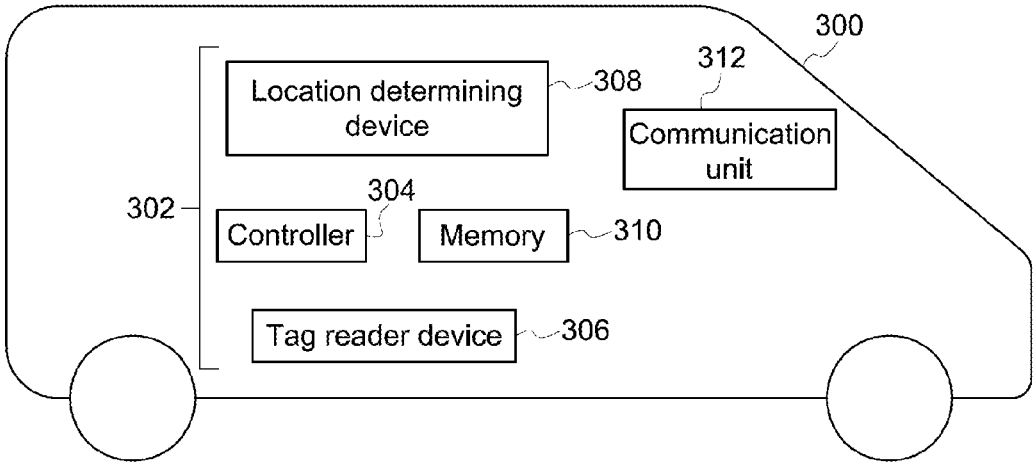
FIG. 3 is a schematic diagram of a vehicle in accordance with one embodiment.

FIG. 3 is a schematic diagram of a vehicle 300 in accordance with one embodiment. The vehicle 300 optionally may be referred to as a vehicle system. The vehicle 300 can represent a single rail vehicle (e.g., a locomotive), plural rail vehicles (e.g., a consist or train), or another type of vehicle (e.g., an automobile, marine vessel, mining vehicle, or the like). The vehicle 300 includes a location and/or direction of travel determining system 302. The system 302 can determine the location of the vehicle 300 along the route 100 (shown in FIG. 1) and/or the direction of travel of the vehicle 300 along the route 100 by reading the location data 106 (shown in FIG. 1) from the tags 102 (shown in FIG. 1), as described above.

The system 302 includes a controller 304 that controls operations of the system 302 and/or the vehicle 300. Optionally, the controller 304 of the system 302 may communicate with a separate controller of the vehicle 300 that controls movement and other operations of the vehicle 300. The controller 304 can include or represent one or more hardware circuits or circuitry that include, are connected with, or that both include and are connected with one or more processors, controllers, or other hardware logic-based devices. The controller 304 can be operably connected with several components as described herein by one or more wired and/or wireless connections.

The controller 304 is operably connected with a tag reader device 306. The tag reader device 306 obtains the location data 106 from the tags 102. The tag reader device 306 can include an RFID reader that generates electromagnetic waves directed at the tags 102. Upon receipt of the waves at the tags 102, the location data 106 may be read from the tags 102 or communicated from the tags 102 to the reader device 306. Alternatively, the device 306 can represent a camera that optically reads location data 106 from the tags 102. For example, the location data 106 may be visible on the tags 102, such as the location data 106 being printed on the tags 102, the tags 102 being signs disposed alongside the route 100 with the location data 106 printed thereon, or the like. Alternatively, the device 306 may be a device that senses magnetic fields or changes in magnetic fields generated by the tags 102. These fields or changes in the fields can represent the location data 106 to allow the location data 106 to be read from the tags 102. Alternatively, the device 306 may be another device configured to read the location data 106 from the tags 102.

The controller 304 also is operably connected with a memory 310. The memory 310 can represent an onboard device that electronically and/or magnetically stores data. For example, the memory 310 may represent a computer hard drive, random access memory, read-only memory, dynamic random access memory, an optical drive, or the like. The memory 310 can store the location data 106 that is read from the tags 102.

The controller 304 is operably connected with a location determining device 308. The device 308 can determine locations of the vehicle 300 separately from the tag reader device 306 obtaining the location data 106 from the tags 102. For example, the location determining device 308 may represent or include a global positioning system receiver that determines locations and/or headings of the vehicle 300. Optionally, the location determining device 308 may include transceiving circuitry and associated hardware (e.g., one or more antennas) that wirelessly communicate with one or more off-board locations (e.g., cellular towers or the like) in order to wirelessly determine the location of the vehicle 300 (e.g., using wireless triangulation). Additionally or alternatively, the location determining device 308 may include a camera that optically detects images; objects; information printed on signs, buildings, or the like; etc., to determine where the vehicle 300 is located (e.g., by comparing the optically detected information with stored images that represent different locations along the route 100). Optionally, the location determining device 308 can include a sensor that detects rotation of wheels and/or axles of the vehicle 300 to determine the location of the vehicle 300. For example, the location determining device 308 can include a tachometer that detects revolutions of one or more wheels of the vehicle 300. The size (e.g., circumference) of the wheel can be stored (e.g., in an internal memory of the device 308, in the memory 310, or elsewhere) and can be used (by the controller 304, the device 308, or another component of the system 302) with the number of revolutions of the wheel to determine how far the vehicle 300 has traveled from a designated location, as described herein.

The controller 304 is operably connected with a communication unit 312. The communication unit 312 includes or represents hardware and/or software that is used to communicate with off-board locations, such as other vehicles, repair facilities, or the like. For example, the communication unit 312 may include a transceiver and associated circuitry (e.g., antennas) for wirelessly communicating (e.g., communicating and/or receiving) messages. The communication unit 312 can communicate identification of a misplaced tag 102 to an off-board location, such as a repair facility, so that the repair facility can schedule inspection and/or repair of the misplaced tag 102.

In one embodiment, a method (e.g., for determining a direction of travel of a vehicle) includes obtaining location data from wayside devices. The location data are representative of locations of the wayside devices along a route being traveled by a vehicle. The method also can include determining whether the location data in a series of the wayside devices exhibit an increase or a decrease in the location data across the wayside devices in the series and, responsive to determining whether the location data in the series of the wayside devices does exhibit the increase or the decrease in the location data, determining one or more of a direction of travel of the vehicle along the route and/or a location of the vehicle along the route.

In one aspect, the method also can include, responsive to determining that the location data in the series of the wayside devices does not exhibit the increase or the decrease in the location data, determining that one or more of the wayside devices is misplaced along the route.

In one aspect, determining whether the location data in the series of the wayside devices exhibit the increase or decrease in the location data can include determining whether at least three neighboring wayside devices of the wayside devices include the location data that consistently increases or that consistently decreases across the neighboring wayside devices.

In one aspect, obtaining the location data can include obtaining first location data from a first wayside device of the wayside devices, subsequently obtaining second location data from a second wayside device of the wayside devices, and subsequently obtaining third location data from a third wayside device of the wayside devices.

In one aspect, the direction of travel of the vehicle can be determined responsive to determining that the second location data of the second wayside device represents a farther distance from a designated location than the first location data of the first wayside device and that the third location data of the third wayside device represents a farther distance from the designated location than the second location data of the second wayside device.

In one aspect, the direction of travel of the vehicle can be determined responsive to determining that the second location data of the second wayside device represents a shorter distance from a designated location than the first location data of the first wayside device and that the third location data of the third wayside device represents a shorter distance from the designated location than the second location data of the second wayside device.

In one aspect, obtaining the location data from the wayside devices can include interrogating radio frequency identification tags disposed alongside the route.

In one aspect, the method also can include scheduling one or more of inspection or repair of the wayside devices responsive to determining that the location data in the series of the wayside devices does not exhibit the increase or the decrease in the location data.

In another embodiment, a system (e.g., a direction of travel determining system) includes a tag reader device and a controller. The tag reader device is configured to obtain location data from wayside devices. The location data is representative of locations of the wayside devices along a route being traveled by a vehicle. The controller is configured to determine whether the location data in a series of the wayside devices exhibit an increase or a decrease in the location data across the wayside devices in the series and, responsive to determining whether the location data in the series of the wayside devices does exhibit the increase or the decrease in the location data, to determine a direction of travel of the vehicle along the route.

In one aspect, the controller also can be configured to determine that one or more of the wayside devices is misplaced along the route responsive to determining that the location data in the series of the wayside devices does not exhibit the increase or the decrease in the location data.

In one aspect, the controller can be configured to determine whether the location data in the series of the wayside devices exhibit the increase or decrease in the location data by determining whether at least three neighboring wayside devices of the wayside devices include the location data that consistently increases or that consistently decreases across the neighboring wayside devices.

In one aspect, the tag reader device can be configured to obtain the location data by obtaining first location data from a first wayside device of the wayside devices, subsequently obtaining second location data from a second wayside device of the wayside devices, and subsequently obtaining third location data from a third wayside device of the wayside devices.

In one aspect, the controller can be configured to determine the direction of travel of the vehicle responsive to determining that the second location data of the second wayside device represents a farther distance from a designated location than the first location data of the first wayside device and that the third location data of the third wayside device represents a farther distance from the designated location than the second location data of the second wayside device.

In one aspect, the controller can be configured to determine the direction of travel of the vehicle responsive to determining that the second location data of the second wayside device represents a shorter distance from a designated location than the first location data of the first wayside device and that the third location data of the third wayside device represents a shorter distance from the designated location than the second location data of the second wayside device.

In one aspect, the tag reader device can be configured to obtain the location data from the wayside devices by interrogating radio frequency identification tags disposed alongside the route.

In one aspect, the controller can be configured to communicate a signal to a location that is off-board of the vehicle to schedule one or more of inspection or repair of the wayside devices responsive to determining that the location data in the series of the wayside devices does not exhibit the increase or the decrease in the location data.

In another embodiment, a method (e.g., for identifying a misplaced tag along a route) includes obtaining location data from radio frequency identification tags disposed at different locations along a route. The location data is representative of the locations of the tags along the route from a designated location. The method also includes determining whether the location data in a series of at least three neighboring tags of the tags includes a sequential increase or a sequential decrease in the location data across the at least three neighboring tags and, responsive to determining that the location data across the at least three neighboring tags does not include the sequential increase or the sequential decrease in the location data, identifying one or more of the at least three neighboring tags as a misplaced tag.

In one aspect, determining whether the location data in the series of the at least three neighboring tags includes the sequential increase or the sequential decrease in the location data can include determining whether the location data obtained from a first tag of the at least three neighboring tags represents a shorter distance from the designated location than the location data obtained from a subsequent, second tag of the at least three neighboring tags and whether the location data obtained from a subsequent, third tag of the at least three neighboring tags represents a longer distance from the designated location than the location data obtained from the second tag.

In one aspect, determining whether the location data in the series of the at least three neighboring tags includes the sequential increase or the sequential decrease in the location data can include determining whether the location data obtained from a first tag of the at least three neighboring tags represents a farther distance from the designated location than the location data obtained from a subsequent, second tag of the at least three neighboring tags and whether the location data obtained from a subsequent, third tag of the at least three neighboring tags represents a shorter distance from the designated location than the location data obtained from the second tag.

In one aspect, the method also can include, responsive to identifying the one or more of the at least three neighboring tags as the misplaced tag, scheduling one or more of repair or inspection of the misplaced tag.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

This written description uses examples to disclose several embodiments of the inventive subject matter and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand-alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

What is claimed is:

1. A method comprising:

obtaining location data from wayside devices, the location data representative of locations of the wayside devices along a route being traveled by a vehicle;

determining whether the location data in a series of the wayside devices exhibit an increase or a decrease in the location data across the wayside devices in the series;

responsive to determining whether the location data in the series of the wayside devices does exhibit the increase or the decrease in the location data, determining one or more of a direction of travel of the vehicle along the route or a location of the vehicle along the route;

determining that one or more of the wayside devices is misplaced along the route responsive to determining that the location data in the series of the wayside devices does not exhibit the increase or the decrease in the location data; and controlling movement of the vehicle based on the one or more of the direction of travel or the location of the vehicle using a controller of the vehicle.

2. The method of claim 1, wherein determining whether the location data in the series of the wayside devices exhibit the increase or decrease in the location data includes determining whether at least three neighboring wayside devices of the wayside devices include the location data that consistently increases or that consistently decreases across the neighboring wayside devices.

3. The method of claim 1, wherein obtaining the location data includes obtaining first location data from a first wayside device of the wayside devices, subsequently obtaining second location data from a second wayside device of the wayside devices, and subsequently obtaining third location data from a third wayside device of the wayside devices.

4. The method of claim 3, wherein the direction of travel of the vehicle is determined responsive to determining that the second location data of the second wayside device represents a farther distance from a designated location than the first location data of the first wayside device and that the third location data of the third wayside device represents a farther distance from the designated location than the second location data of the second wayside device.

5. The method of claim 3, wherein the direction of travel of the vehicle is determined responsive to determining that the second location data of the second wayside device represents a shorter distance from a designated location than the first location data of the first wayside device and that the third location data of the third wayside device represents a shorter distance from the designated location than the second location data of the second wayside device.

6. The method of claim 1, wherein obtaining the location data from the wayside devices includes interrogating radio frequency identification tags disposed alongside the route.

7. The method of claim 1, further comprising scheduling one or more of inspection or repair of the wayside devices responsive to determining that the location data in the series of the wayside devices does not exhibit the increase or the decrease in the location data.

8. The method of claim 1 wherein controlling the movement of the vehicle includes one or more of:

automatically engaging a brake of the vehicle based on the one or more of the direction of travel the location of the vehicle; or preventing the vehicle from entering into a location based on the one or more of the direction of travel or the location of the vehicle.

9. A system comprising:

a tag reader device configured to obtain location data from wayside devices, the location data representative of locations of the wayside devices along a route being traveled by a vehicle; and a controller configured to determine whether the location data in a series of the wayside devices exhibit an increase or a decrease in the location data across the wayside devices in the series and, responsive to determining whether the location data in the series of the wayside devices does exhibit the increase or the decrease in the location data, to determine a direction of travel of the vehicle along the route, wherein the controller is configured to control movement of the vehicle based on the or or more of the direction of travel or the location of the vehicle, and wherein the controller also is configured to determine that one or more of the wayside devices is misplaced along the route responsive to determining that the location data in the series of the wayside devices does not exhibit the increase or the decrease in the location data.

10. The system of claim 9, wherein the controller is configured to determine whether the location data in the series of the wayside devices exhibit the increase or decrease in the location data by determining whether at least three neighboring wayside devices of the wayside devices include the location data that consistently increases or that consistently decreases across the neighboring wayside devices.

11. The system of claim 9, wherein the tag reader device is configured to obtain the location data by obtaining first location data from a first wayside device of the wayside devices, subsequently obtaining second location data from a second wayside device of the wayside devices, and subsequently obtaining third location data from a third wayside device of the wayside devices.

12. The system of claim 11, wherein the controller is configured to determine the direction of travel of the vehicle responsive to determining that the second location data of the second wayside device represents a farther distance from a designated location than the first location data of the first wayside device and that the third location data of the third wayside device represents a farther distance from the designated location than the second location data of the second wayside device.

13. The system of claim 11, wherein the controller is configured to determine the direction of travel of the vehicle responsive to determining that the second location data of the second wayside device represents a shorter distance from a designated location than the first location data of the first wayside device and that the third location data of the third wayside device represents a shorter distance from the designated location than the second location data of the second wayside device.

14. The system of claim 9, wherein the tag reader device is configured to obtain the location data from the wayside devices by interrogating radio frequency identification tags disposed alongside the route.

15. The system of claim 9, wherein the controller is configured to communicate a signal to a location that is off-board of the vehicle to schedule one or more of inspection or repair of the wayside devices responsive to determining that the location data in the series of the wayside devices does not exhibit the increase or the decrease in the location data.

16. The system of claim 9, wherein the controller is configured to control the movement of the vehicle by one or more of:

automatically engaging a brake of the vehicle based on the one or more of the direction of travel or the location of the vehicle; or preventing the vehicle from entering into a location based on the one or more of the direction of travel or the location of the vehicle.

17. A method comprising:

obtaining location data from radio frequency identification tags disposed at different locations along a route, the location data representative of the locations of the tags along the route from a designated location;

determining whether the location data in a series of at least three neighboring tags of the tags includes a sequential increase or a sequential decrease in the location data across the at least three neighboring tags;

responsive to determining that the location data across the at least three neighboring tags does not include the sequential increase or the sequential decrease in the location data, identifying one or more of the at least three neighboring tags as a misplaced tag; and controlling movement of a vehicle based on the location data that is obtained.

18. The method of claim 17, wherein determining whether the location data in the series of the at least three neighboring tags includes the sequential increase or the sequential decrease in the location data includes determining whether the location data obtained from a first tag of the at least three neighboring tags represents a shorter distance from the designated location than the location data obtained from a subsequent, second tag of the at least three neighboring tags and whether the location data obtained from a subsequent, third tag of the at least three neighboring tags represents a longer distance from the designated location than the location data obtained from the second tag.

19. The method of claim 17, wherein determining whether the location data in the series of the at least three neighboring tags includes the sequential increase or the sequential decrease in the location data includes determining whether the location data obtained from a first tag of the at least three neighboring tags represents a farther distance from the designated location than the location data obtained from a subsequent, second tag of the at least three neighboring tags and whether the location data obtained from a subsequent, third tag of the at least three neighboring tags represents a shorter distance from the designated location than the location data obtained from the second tag.

20. The method of claim 17, further comprising, responsive to identifying the one or more of the at least three neighboring tags as the misplaced tag, scheduling one or more of repair or inspection of the misplaced tag.

21. The method of claim 17, wherein controlling the movement of the vehicle includes one or more of:

automatically engaging a brake of the vehicle based on the one or more of the direction of travel or the location of the vehicle; or preventing the vehicle from entering into a location based on the one or more of the direction of travel or the location of the vehicle.

* * * * *